United States Patent [19]

Sawby et al.

[11] 4,240,201

[45] Dec. 23, 1980

[54] FOLDING KNIFE

[76] Inventors: Scott Sawby; Steven W. Mullin, both of Rte. 1, Box 186A, Samuels, Id. 83862

[21] Appl. No.: 65,939

[22] Filed: Aug. 13, 1979

[51] Int. Cl.[3] ..... B26B 1/04

[52] U.S. Cl. ..... 30/161

[58] Field of Search ..... 30/161, 160, 158, 159

[56] References Cited

U.S. PATENT DOCUMENTS

| | | | |
|---|---|---|---|
| 292,473 | 1/1884 | Dieterich et al. | 30/161 X |
| 812,601 | 2/1906 | Schrade | 30/159 |
| 1,090,416 | 3/1914 | Roth | 30/159 |
| 1,373,993 | 4/1921 | Boe | 30/161 |
| 1,852,400 | 4/1932 | Champlin | 30/161 |
| 4,124,939 | 11/1978 | Onoue | 30/161 |

FOREIGN PATENT DOCUMENTS

| | | | |
|---|---|---|---|
| 1051848 | 9/1953 | France | 30/161 |

*Primary Examiner*—Jimmy C. Peters

*Attorney, Agent, or Firm*—Wells, St. John & Roberts

[57] ABSTRACT

A folding knife providing a safety lock mechanism that securely locks the blade in an open position. A bar spring in the handle is anchored at the rear handle end. Its opposite end is freely biased against the edge surfaces of the tang of a foldable blade. The bar spring includes a latch configuration complementary to a catch formed across the tang, which interfit when the blade is open. A transverse pushbutton serves to cam the free end of the bar spring from engagement with the blade when it is to be folded to a closed position.

11 Claims, 6 Drawing Figures

FOLDING KNIFE

BACKGROUND OF THE INVENTION

The present invention is related to folding knives that provide a safety lock feature to prevent unintended closure of the knife blade.

A folding "pocket" knife has a folding blade that is pivoted to a handle about a pin transverse to the length of the knife. The blade "tang" or base is typically curved about the pivot pin. An elongated bar spring on the handle rides against the tang surface to prevent or resist undesired movement of the blade between its open and closed positions.

Some folding knives have a safety lock feature which will prevent inadvertent folding of the blade from the open to the closed position. Blades that do not have this safety feature are a potential hazard. An unlocked blade can fold quickly to its closed position in response to forces applied in a direction substantially perpendicular to the folding pin. Such forces may be applied by the user making a forward thrusting or gouging motion with the knife. The blade will quickly move toward the closed position and might severely cut the user's hand.

Various mechanisms have been designed to securely lock folding knife blades in the open position. They are typically complex and add substantially to the cost of the knife. Further, the additional elements involved increase the chance of malfunction and early wear.

U.S. Pat. No. 1,258,150 to Schrade discloses a self-opening, locking and unlocking pocketknife. A button on the side of the handle is used to actuate a spring mechanism for opening the blade. The button is also movable longitudinally to bring a locking member into engagement with the tang of the blade, locking it into position. U.S. Pat. No. 400,987 to Wilzen and U.S. Pat. No. 2,530,236 to Erickson both disclose pocketknives with button locking and unlocking devices. The buttons are spring-actuated on the blade handles. Notches are formed in the blade tangs. Parts of the pins on the buttons include a shape complementary to the notches formed in the tangs. The tang notches and complementary button portions align with one another when the blades are in the open position. Movement of the buttons into engagement with the notches serves to lock the blades in the open position. Another axial part of each button is of reduced cross-section. When the buttons are pushed to bring the reduced portions into the tang notches the blades will release and can be closed.

U.S. Pat. No. 2,183,378 to Conklin shows a safety pushbutton knife. Here, the button is connected to a pivot lever (FIG. 2), one end of which is engaged with the button and the opposite end is engaged with a notch on the blade tang.

U.S. Pat. No. 2,304,601 to Schrade discloses another form of pocket knife having a slide operated detent mechanism for "locking" the blade in an open position.

Another presently available knife has a locking arrangement comprised of a spring release mechanism at a rearward end of the handle adjacent the blade spring bar. Actuation of the release causes pivotal movement of a dog from engagement with the locking spring. These mechanisms are somewhat simpler than the prior button arrangements but have drawbacks both in safety and in economics. The position of the release on the handle requires a haphazard grip to move the blade safely to the closed position. In addition the added elements and machining necessarily add to the cost of the knives.

It therefore becomes desirable to obtain some form of folding knife with a simple, uncomplicated and inexpensive locking mechanism for securely holding the blade in an open position. It is also desirable to have such a device on the knife blade that is situated for ease in operator control and safety.

DETAILED DESCRIPTION OF A PREFERRED EMBODIMENT

Figure 1:
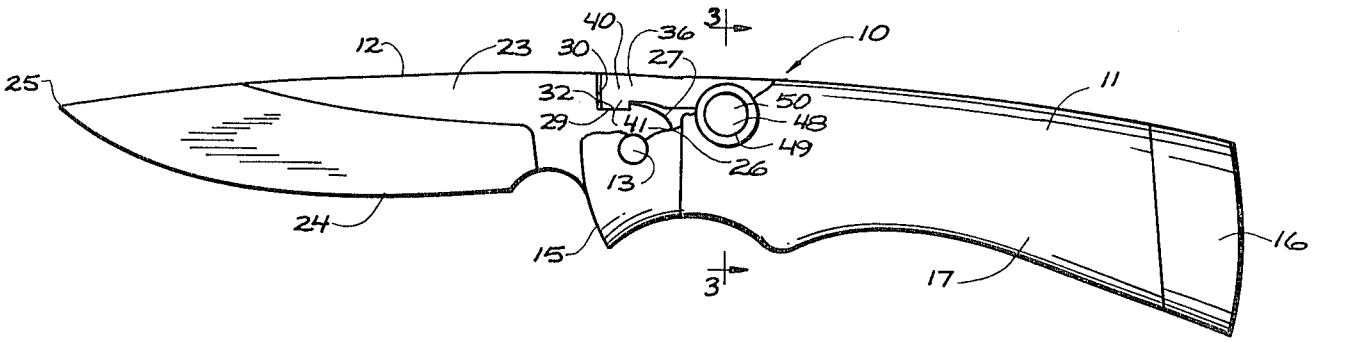
FIG. 1 is a partially fragmented elevational view with the blade shown open.

A knife embodying a preferred form of the present invention is illustrated at 10 in the accompanying drawings. The knife 10 is a folding form of knife that can be made in many different configurations. Generally, the knife includes a handle 11 and a folding blade 12. The folding blade 12 is mounted by a pivot pin 13 to the knife handle 11. The blade is folded by pivoting about the axis of the pivot pin 13 between an open position (FIG. 1) and a closed position (FIG. 2). The present knife includes specific safety features within its assembly that enable selective locking of the blade in the open, FIG. 1 position.

The handle 11 includes a bolster 15 at a front handle end and a bolster 16 at a rear handle end. Side plates 17 with appropriate hand grip surfaces extend between the bolsters 15 and 16. A recess 18 is formed between the sides and ends for the purpose of receiving the blade 14 when it is pivoted to the closed position.

The blade includes a longitudinal narrow shank 23 having a cutting edge 24 formed along one side thereof. The edge 24 leads to a pointed tip 25. The blade has an opposite enlarged back edge for strength.

Opposite the blade tip 25 is the blade tang 26. The tang 26 is mounted to the pivot pin 13 and is sandwiched between the side plates 17. The tang 26 includes a rounded inner edge surface 27 (FIG. 2) generated about the pin axis. On opposite sides of the rounded surface 27 are a flat surface 28 [illegible]ding to cutting edge 24 and a catch 29 formed across the tang 26 at the back edge of the blade. The flat surface 28 is yieldably engageable by a bar spring (described below) to releasably hold the blade in its closed position. The catch 29 is part of a locking mechanism by which the blade is selectively securely locked in its open position.

The catch 29 includes a rearwardly facing shoulder 30 (when the blade is open) and a forwardly facing notch 31. An indent 32 separates them. It is thus seen that the catch 29 is in the form of a substantially rectangular transverse slot formed across the tang to one side of its pivot axis.

The tang is yieldably engaged by a bar spring 36. The bar spring 36 is integrally formed of spring metal mounted at one end 37 (FIG. 2) to the handle. The spring base end 37 is affixed permanently between side plates 17 by rivets 38 to the handle at the rear bolster 16. The remainder of the spring extends freely between the side plates 17 along the length of the handle. The bar spring defines the longitudinal closed wall of the blade receiving recess 18, facing blade cutting edge 24 when the blade is in its closed position. The thin spring shank 39 extends from the base end 37 to a forward end 40 that yieldably engages tang 26.

Figure 6:
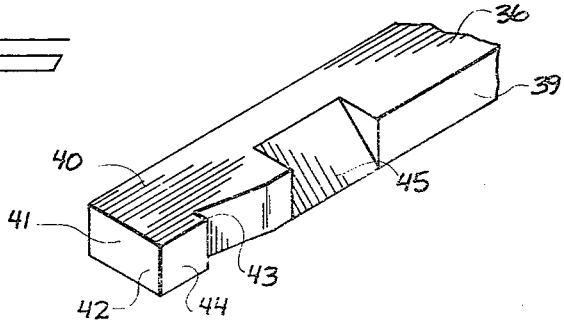
FIG. 6 is a fragmented pictorial view of a cam surface on the spring.

A latch member 41 is formed integrally across bar spring 36 at the forward end of shank 39. The latch member 41 is adapted to snap into and out of engagement with the catch 29. The latch member is formed in a configuration complementary to the catch 29. It includes a forward abutment surface 42 (FIGS. 2 and 6) for engaging the rearwardly facing shoulder 30 and a rearward abutment surface 43 for engaging the forwardly facing notch 31.

Surfaces 42 and 43 are formed on a boss 44 integral with the spring at its forward end 40. Depth of boss 44 is equal to that of the catch 29. Therefore, a close engagement between the latch member 41 and catch 29 can be expected at the open position of the blade. This assures that the blade will not pivot accidently or intentionally in either direction about the pin axis without the latch on the bar spring being first disengaged from the catch on the blade tang.

Rearward from the latch member 41 along the bar spring 36 is a cam surface 45. It is formed as an inclined plane that faces into the recess 18. It is preferred that the inclined plane be approximately 45° with respect to the pin axis.

Figure 3:
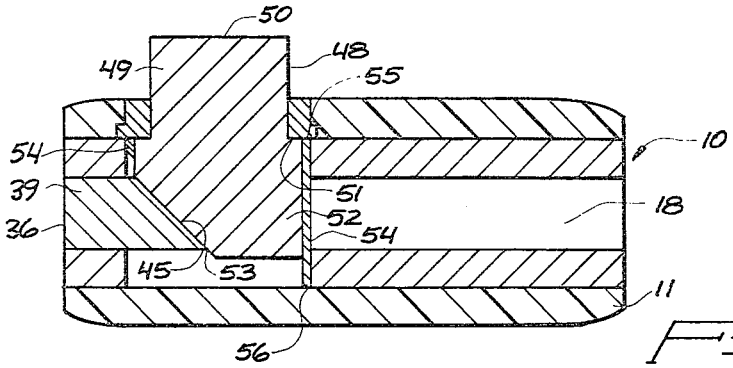
FIG. 3 is a section along line 3—3 in FIG. 1.
Figure 4:
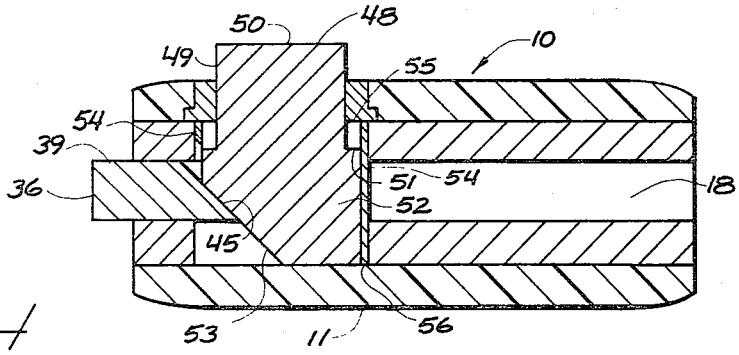
FIG. 4 is a view similar to FIG. 3 showing the button mechanism being actuated.

A pushbutton actuator means 48 is provided for selective engagement with the cam surface 45. The pushbutton actuator means 48 is hand manipulated to move the spring latch member 41 from the latch position (FIG. 3) to an unlatched position (FIG. 4) wherein the blade can be folded to its closed position. The actuator means functions in response to force supplied in a direction transverse to the handle and substantially parallel to the pivot pin axis.

Figure 5:
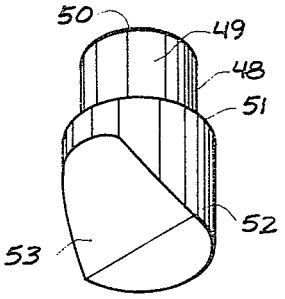
FIG. 5 is a pictorial view of the pushbutton actuator.

The actuator means 48 is basically a pushbutton mechanism, having a cylindrical barrel 49 with a pushbutton surface 50 at an outwardly exposed end thereof (FIG. 5). The button includes an outwardly projecting shoulder 51 that prevents escape of the button through an access aperture formed in the appropriate handle side. A bottom cylindrical section 52 extends coaxial with cylinder barrel 59 from the lower shoulder 51. Section 52 includes an inclined planar surface 53 that slidably engages the cam surface 45. Surface 53 is also inclined from the axis of pin 13 by an angle of approximately 45°. The complementary surface 53 will therefore maintain flush surface-to-surface sliding engagement with the cam surface 45.

The cylindrical barrels 49 and 52 are slidably received within a cylindrical housing 54. The housing 54 is secured between the side plates 17 of the handle adjacent the front bolster. The housing 54 includes a top shoulder 55 and a bottom shoulder 56. The shoulders 55 and 56 come into engagement with the interior surfaces of the side plates 17 to prevent longitudinal movement of the pushbutton actuator.

The housing 54 also includes an inclined opening facing the cam surface 45. The opening is angularly inclined to allow action of cam surface 45 and surface 53 of the pushbutton actuator. The remainder of the housing 54 guides the cylindrical portions of the pushbutton for axial movement. This axial movement of the pushbutton actuator results in perpendicular movement of cam surface 45 and bar spring 36.

The housing 54 provides an additional function as a stop to prevent engagement of the blade edge 24 with the spring shank 39. It serves as an abutment for contact by an indentation 56 formed in the blade shank adjacent tang 26. FIG. 2 shows the spacing between the edge 24 and spring 36 when the blade is closed and indentation 56 is directly engaging housing 54. The blade therefore cannot be dulled by forcible movement against the metal surface of the spring 36.

Figure 2:
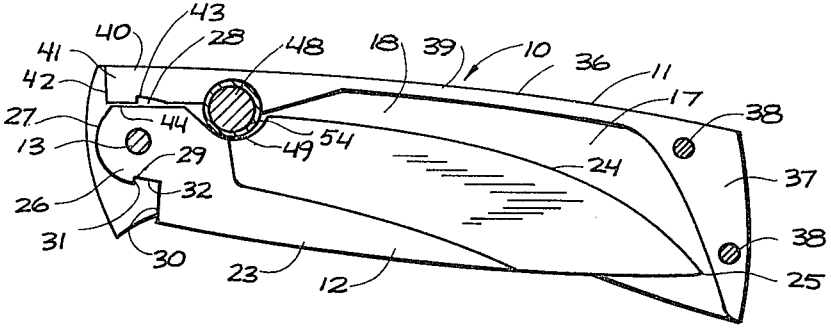
FIG. 2 is a longitudinal sectional view showing the blade closed.

Operation of the present invention may best be understood with reference to FIGS. 1 and 2. The operation may be best described starting with the knife in the condition shown in FIG. 2. Here, the blade is folded to the closed position, freely received within the handle recess 18.

Opening of the knife to the FIG. 1 position is accomplished by holding the knife handle in one hand. The blade is then grasped by the fingers of the remaining hand and pulled to the open position. This is accomplished in opposition to the bar spring 36 which has its forward end 40 slidably engaging the edges of the tang 26. The resistance offered, however, is only sufficient to prevent undesired free pivotal movement of the blade to the open position.

The blade will become locked securely in the open position when fully extended longitudinally from the handle. This is accomplished as the latch member 41 snaps into engagement with the catch 29. The interlocking relationship is shown in FIG. 1. The interlocked surfaces of the latch member 41 and catch 29 effectively prevent any further pivotal movement of the blade and handle about the axis of pin 13. The only way the blade can be released and returned to the closed position is through operation of the pushbutton actuator.

The actuator and blade disclosed herein may be operated by one hand. The actuator button is positioned toward the front end of the handle so that the knife may be held naturally while the thumb of the holding hand is used to push the button inwardly. The inward force moves the inclined surface 53 against the cam surface 45. The forces applied against the inclined planes causes perpendicular movement of the spring end 40 relative to the handle and blade. The resulting movement of the spring 36 causes disconnection of the latch member 41 and catch 29.

The blade is then unlocked and free to pivot on the pin axis back to the closed position. When inward force on the pushbutton is released, the spring action will operate in reverse, driving the cam surface 45 against the inclined surface 53. The button is thereby moved outwardly along its axis to return to the normal, inoperative position. Bar spring 36 thereby serves to yieldably bias the pushbutton 48 as well as the foldable knife blade 12.

The knife can be opened and closed with the hands of the operator positioned normally and safely on the handle and blade. Closure of the knife is accomplished with the carrying hand clear of the blade passage and of the recess 18 to assure safety in returning the blade to the closed position. Further safety is assured in the locking mechanism which will prevent undesired movement of the blade from the open to the closed position.

The above description has been given by way of example to set forth a preferred form of our invention. The following claims, however, may be taken as more specifically setting forth the scope of the invention.

What we claim is:

1. A folding knife, comprising:

an elongated handle having a longitudinal open blade receiving recess;

a blade having a longitudinal cutting edge extending to an outward end and a tang at an inward end;

a pin extending through the tang, pivotably mounting the blade to the handle for movement about a transverse axis between an open position projecting longitudinally from the handles and a closed position wherein the blade is received within the blade receiving recess;

a catch on the tang;

a spring on the handle;

a latch member on the spring urged against the tang for sliding over the tang and snapping into engagement with the catch when the blade is moved to the open position, securely locking the blade against pivotal movement about the pin relative to the handle;

a cam surface on the spring, adjacent the latch member and facing the blade receiving recess; and a pushbutton actuator means on the handle, manually movable against the cam surface for moving the latch member from engagement with the catch.

2. The knife as defined by claim 1 wherein the cam surface is comprised of a planar inclined surface formed integrally across the spring and wherein the cam actuator means is comprised of a pushbutton having a complementary planar inclined surface thereon engaging for sliding movement against the planar inclined surface of the spring.

3. The knife as defined by claim 1 wherein the pushbutton actuator means is mounted to the handle adjacent the pin and extends through the open recess; and wherein the blade includes an indentation adjacent its tang for abutting said pushbutton actuator means when the blade has been folded to its closed position.

4. The knife as defined by claim 3 wherein the pushbutton actuator means includes a housing member mounted to the handle and a pushbutton slidably carried within the housing, and wherein the indentation engages the housing when the blade has been folded to its closed position.

5. The knife as defined by claim 1 wherein the spring is comprised of an elongated bar having a rearward end affixed to the handle and with the latch member at a forward end thereon and wherein the cam surface is comprised of an inclined planar surface formed across the bar rearwardly adjacent the latch member.

6. The knife as defined by claim 5 wherein the pushbutton actuator means includes an inclined surface complementary to the inclined planar surface of the cam surface, and an elongated body slidably mounted to the housing for moving in a path substantially parallel to the axis of the pin in response to manual force applied thereto for moving the inclined surface of the actuator against the inclined surface of the cam surface, shifting the cam surface and spring in a direction perpendicular to the direction of movement of the pushbutton actuator means.

7. The knife as defined by claim 6 wherein the pushbutton actuator means is mounted to the handle adjacent the pin and extends through the open recess; and wherein the blade includes an indentation adjacent its tang for abutting against the pushbutton actuator means when the blade is moved to its closed position.

8. The knife as defined by claim 7 wherein the pushbutton actuator means includes a housing member mounted to the handle and a pushbutton slidably carried within the housing, and wherein the indentation engages the housing when moved to its closed position.

9. The knife as defined by claim 1 wherein the cam surface is an inclined plane facing the blade receiving recess and inclined approximately 45° with respect to the axis of the pin.

10. The knife as defined by claim 9 wherein the pushbutton actuator means includes:

a substantially cylindrical housing mounted to the handle adjacent the blade tang, along an axis parallel to the blade pivot axis;

a pushbutton member mounted within the housing for co-axial sliding movement therein and having an inclined surface for engagement with the cam surface; and wherein the inclined surface on the pushbutton member is inclined from the pivot axis of the blade approximately 45° for flush, slidable engagement with the cam surface.

11. A knife comprising:

an elongated handle having front and rear ends and including a pair of transversely spaced side plates separated by an elongated yieldable bar spring fixed between the side plates at the rear handle end and extending freely between them to the front handle end;

a blade having a cutting edge and an opposite enlarged back edge, said blade including a tang at the inner end thereof;

means operably connecting the front handle end and the tang of the blade for pivotally supporting the blade relative to the handle to enable the blade to be folded between an open position projecting outwardly from the handle and a closed position located between the side plates of the handles;

a catch formed across the tang at the back edge of the blade;

latch means formed across the bar spring adjacent the front handle end, said latch means being complementary to said catch and being biased by the bar spring against the tang for locking engagement with the catch when the blade is in its open position;

a cam surface on the bar spring adjacent said latch means; and push button actuator means movably mounted on the handle adjacent the front handle end and engaging the cam surface for selectively disengaging the latch means from the catch in response to manual actuation, to enable the blade to be folded to its closed position.

* * * * *